US006592102B2

(12) United States Patent
Telles

(10) Patent No.: US 6,592,102 B2
(45) Date of Patent: Jul. 15, 2003

(54) MOUNTING DEVICE FOR CHAINLINK FENCES

(76) Inventor: Doris P. Telles, P.O. Box 452, 28525 Highway 243, Mountain Center, CA (US) 92561

( * ) Notice: Subject to any disclaimer, the term of this patent is extended or adjusted under 35 U.S.C. 154(b) by 158 days.

(21) Appl. No.: 09/761,730

(22) Filed: Jan. 18, 2001

(65) Prior Publication Data

US 2001/0048102 A1 Dec. 6, 2001

Related U.S. Application Data

(60) Provisional application No. 60/176,315, filed on Jan. 18, 2000.

(51) Int. Cl.[7] ..... G09F 7/02

(52) U.S. Cl. ..... 256/1; 256/32; 24/570; 24/335

(58) Field of Search ..... 256/1, 32, 47; 40/308, 584, 611; 24/455, 546, 563, 570, 335, 336; 248/231.8, 74.1

(56) References Cited

U.S. PATENT DOCUMENTS

| | | | | | |
|---|---|---|---|---|---|
| 374,931 | A | * | 12/1887 | Brooks | 24/336 |
| 2,186,410 | A | * | 1/1940 | Freysinger | 24/336 |
| 2,620,532 | A | * | 12/1952 | Bedford, Jr. | 24/336 |
| 3,964,197 | A | * | 6/1976 | Tucker et al. | 40/584 X |

* cited by examiner

*Primary Examiner*—Lynne H. Browne
*Assistant Examiner*—John Cottingham
(74) *Attorney, Agent, or Firm*—Patent & Trademark Services; Joseph H. McGlynn

(57) ABSTRACT

Mounting devices for mounting items such as signs to chainlink fences. The devices have at least one tab punched out of each end of the mounting and a portion of the chainlink fence is received between the tab and the remainder of the mounting device, which attaches the mounting device to the fence. The mounting device has apertures which will receive fasteners to secure a sign to the mounting device which in turn is secured to the fence.

19 Claims, 2 Drawing Sheets

MOUNTING DEVICE FOR CHAINLINK FENCES

Applicant claims the priority of Provisional Ser. No. 60/176315, filed Jan. 18, 2000.

BACKGROUND OF THE INVENTION

This invention relates, in general, to mounting devices, and, in particular, to mounting devices for chainlink fences.

SUMMARY OF THE INVENTION

The present invention is directed to mounting devices for mounting items such as signs to chainlink fences. The devices have at least one tab punched out of each end of the mounting and a portion of the chainlink fence is received between the tab and the remainder of the mounting device, which attaches the mounting device to the fence. The mounting device has apertures which will receive fasteners to secure a sign to the mounting device which in turn is secured to the fence.

It is an object of the present invention to provide a new and improved mounting device for attaching items such as signs to chainlink fences.

It is an object of the present invention to provide a new and improved mounting device for attaching items such as signs to chainlink fences which can be easily and quickly attached to a fence.

It is an object of the present invention to provide a new and improved mounting device for attaching items such as signs to chainlink fences which will securely hold the signs to the fence and can be easily and quickly removed if necessary.

These and other objects and advantages of the present invention will be fully apparent from the following description, when taken in connection with the annexed drawings.

DESCRIPTION OF THE PREFERRED EMBODIMENT

Figure 1:
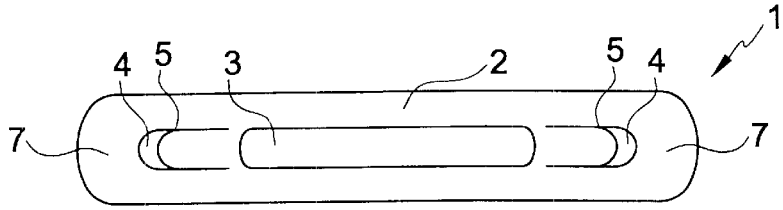
FIG. 1 is top view of one embodiment of the present invention.

Referring now to the drawings in greater detail, FIG. 1 shows a mounting device 1 used to attach items such as signs (not shown) to a fence such as a chainlink fence. The mounting device 1 is a relatively flat piece of material such as metal or plastic which has an intermediate section 2 and two end sections 7. The intermediate section 2 has a slot 3 passing therethrough, and which can be used to fasten a sign to the device 1 by, for example, passing fasteners through the sign and then through the slot 3. It should be noted that any fastening device such as, but not limited to, a bolt and nut can be used to fasten a sign to the device 1.

Each of the end sections of the FIG. 1 device has an aperture 4, out of which has been punched, or otherwise formed, a tab 5. As seen from the side view of FIG. 3, the tab is positioned below the plane of the intermediate portion 2 to form a gap 15 between the tab 5 and the end section 7. As shown in FIG. 4, the device 1 can be secured to a fence having crossed wires 8, 9 by passing the tab 5 beneath the wire 9 and the end section 7 on top of the wire 9. By attaching both ends of the device to the wires 9 in this manner the device can be securely fastened to the fence. In order to attach a sign to the mounting device 1, fasteners, such as a bolt, would be passed through the sign, then passed through the slot 3 and a complimentary fastener, such as a nut, would be secured to the bolt to secure the sign to the mounting device 1. Obviously, more than one tab 5 could be formed in the end sections without departing from the scope of the invention.

Figure 2:
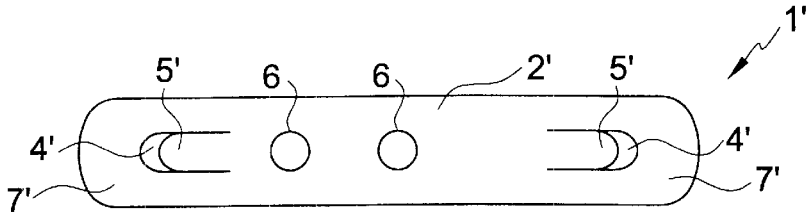
FIG. 2 is a top view of another embodiment of the present invention.

FIG. 2 shows a modified version 1' of the FIG. 1 mounting device which has an intermediate section 2' and two end sections 7'. The intermediate section 2' has a plurality of apertures 6 passing therethrough, and which can be used to fasten a sign to the device 1' by, for example, passing fasteners through the sign and then through the apertures 6. It should be noted that any fastening device such as, but not limited to, a bolt and nut can be used to fasten a sign to the device 1'.

Each of the end sections of the FIG. 2 device has an aperture 4', out of which has been punched, or otherwise formed, a tab 5'. The tabs 5' serve the same purpose as the tabs 5 in the FIG. 1 device, and the apertures 6 serve the same purpose as the slot 3 in the FIG. 1 device.

Figure 5:
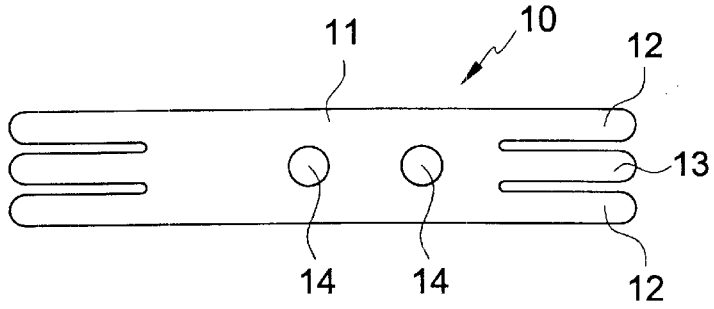
FIG. 5 is top view of another embodiment of the present invention.
Figure 7:
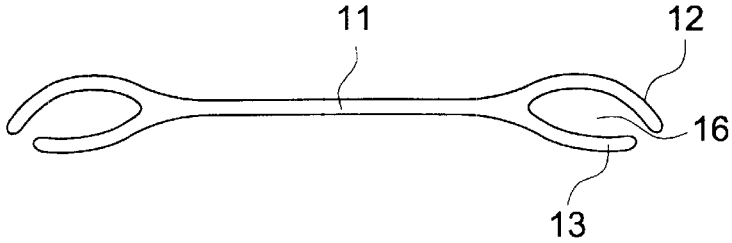
FIG. 7 is a side view of the FIG. 5 embodiment of the present invention.

FIG. 5 shows another modified version 10 of the FIG. 1 device. The FIG. 5 device has an intermediate section 11, through which two apertures 14 pass. The apertures 14 serve the same purpose as the Gus apertures 6 in the FIG. 2 device. The ends have a plurality of fingers 12, 13 formed thereon in any conventional manner. As shown in FIG. 7, the finger 13 is pressed down out of the plane of the device 10 while the fingers 12 are raised slightly above the plane of the device thereby forming a gap 16 which functions in the same manner as the gap 15 in the FIG. 1 device. It should be noted that while the drawings show the finger 13 below and the fingers 12 above the plane of the FIG. 5 device, this arrangement could be reversed (fingers 12 below and finger 13 above the plane of the device) without departing from the scope of the invention.

Figure 6:
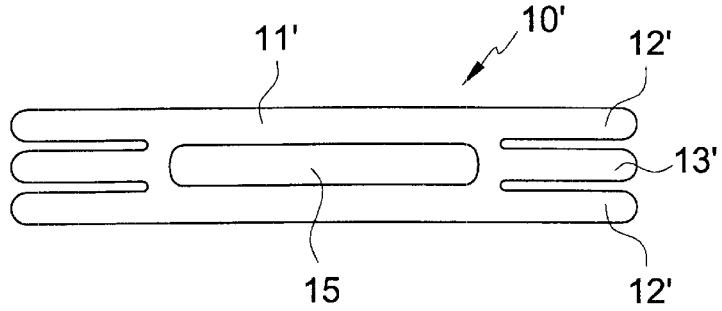
FIG. 6 is a top view of another embodiment of the present invention.

FIG. 6 shows a modified version 10' of the FIG. 5 device. The FIG. 6 device has an intermediate section 11', through which a slot 15 passes, and which serves the same function as the slot 3 in the FIG. 1 device. The ends have a plurality of fingers 12', 13' formed thereon in any conventional manner. The fingers 12', 13' serve the same function as the fingers 12, 13 of the FIG. 5 device. Obviously more than one finger 13, 13 could be formed in the end sections without departing from the scope of the invention.

Figure 3:
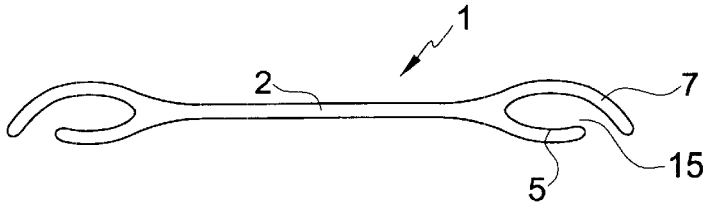
FIG. 3 is a side view of the FIG. 1 embodiment of the present invention.
Figure 4:
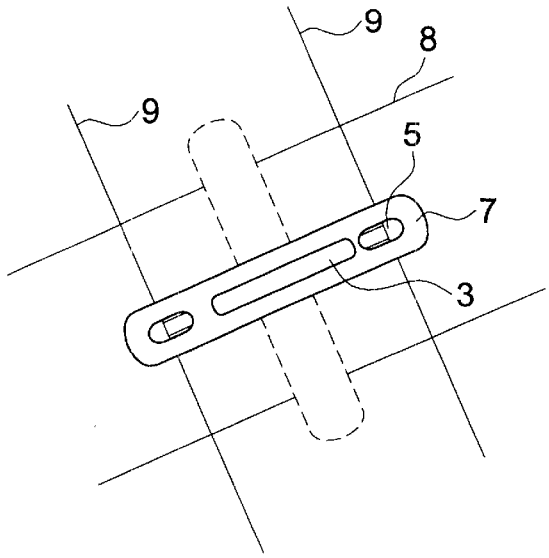
FIG. 4 is a view of the FIG. 1 embodiment of the present invention attached to a fence.
Figure 8:
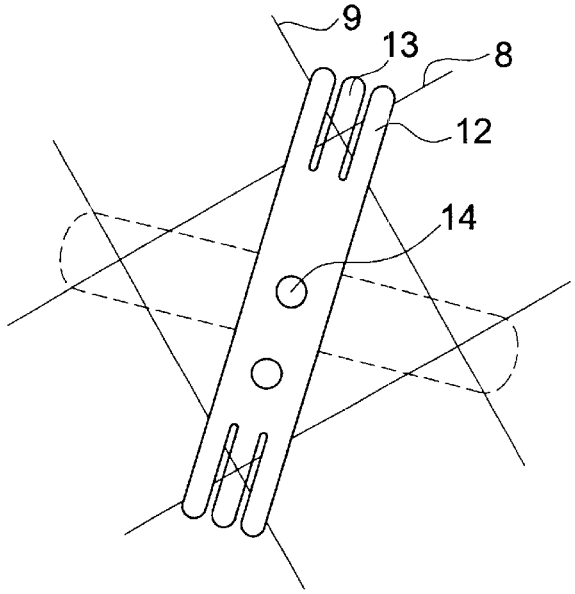
FIG. 8 is a view of the FIG. 5 embodiment of the present invention attached to a fence.

FIG. 7 shows the FIG. 5 device in a side view similar to the side view in FIG. 3 of the FIG. 1 device. In addition, FIG. 8 shows the FIG. 5 device attached to a fence having wires 8, 9 similar to FIG. 4. also, it should be noted that in FIGS. 4 and 8, the dotted lines indicate that either device can be mounted as shown in solid lines or the device can be rotated 90° and mounted in the position shown by the dotted lines in each figure. Which way the devices will be turned will be dictated by the sign that is attached.

Although the Mounting Devices for Chainlink Fences and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A mounting device for attaching items to a fence said fence having at least two strands of wire, said mounting device comprising:

a body member having an intermediate section and two end sections, said intermediate section being formed in a first plane, and at least portions of said two end sections being formed in planes which are not colinear with said first plane, said intermediate section having means for attaching an item to said mounting device, each said end section having means for attaching said mounting device to said fence, said means for attaching said mounting device to said fence comprising a first portion which is positioned in a plane which is above said first plane, and said means for attaching said mounting device to said fence comprising a second portion which is positioned in a plane which is below said first plane.

2. The mounting device as claimed in claim 1, wherein said means in said intermediate section for attaching an item to said mounting device is a slot.

3. The mounting device as claimed in claim 1, wherein said means in said intermediate section for attaching an item to said mounting device is a plurality of apertures.

4. The mounting device as claimed in claim 1, wherein said first portion of said means for attaching said mounting device to said fence is a unitary portion of said end section, and said second portion of said means for attaching said mounting device to said fence is a tab formed from said end section.

5. The mounting device as claimed in claim 4, wherein said first and second portions form an open ended gap.

6. The mounting device as claimed in claim 1, wherein said first portion of said means for attaching said mounting device to said fence is at least one finger formed on said end section, and said at least one finger is attached at one end to said intermediate section and has an opposite end which is a free end, said second portion of said means for attaching said mounting device to said fence is at least one finger which is attached at one end to said intermediate section and has an opposite end which is a free end.

7. The mounting device as claimed in claim 6, wherein said first and second portions form an open ended gap.

8. The mounting device as claimed in claim 6, wherein said means in said intermediate section for attaching an item to said mounting device is a slot.

9. The mounting device as claimed in claim 6, wherein said means in said intermediate section for attaching an item to said mounting device is a plurality of apertures.

10. A mounting device for attaching items to a fence said fence having at least two strands of wire, said mounting device consisting of:

a body member being formed as a single, unitary piece, said body member having an intermediate section and two end sections, said intermediate section being formed in a first plane, and at least portions of said two end sections being formed in planes which are not colinear with said first plane, said intermediate section having means for attaching an item to said mounting device, each said end section having means for attaching said mounting device to said fence, said means for attaching said mounting device to said fence comprising a first portion which is positioned in a plane which is above said first plane, and said means for attaching said mounting device to said fence comprising a second portion which is positioned in a plane which is below said first plane.

11. A mounting device for attaching items to a fence in combination with a fence, said fence having at least two strands of wire, said mounting device comprising:

a body member having an intermediate section and two end sections, said intermediate section being formed in a first plane, and at least portions of said two end sections being formed in planes which are not colinear with said first plane, said intermediate section having means for attaching an item to said mounting device, each said end section having means for attaching said mounting device to said fence, said means for attaching said mounting device to said fence comprising a first portion which is positioned in a plane which is above said first plane, and is positioned on one side of at least one of said two strands of wires, said means for attaching said mounting device to said fence comprising a second portion which is positioned in a plane which is below said first plane, and is positioned on another side of at least one of said two strands of wires.

12. The mounting device as claimed in claim 11, wherein said means in said intermediate section for attaching an item to said mounting device is a slot.

13. The mounting device as claimed in claim 11, wherein said means in said intermediate section for attaching an item to said mounting device is a plurality of apertures.

14. The mounting device as claimed in claim 11, wherein said first portion of said means for attaching said mounting device to said fence is a unitary portion of said end section, and said second portion of said means for attaching said mounting device to said fence is a tab formed from said end section.

15. The mounting device as claimed in claim 14, wherein said first and second portions form an open ended gap.

16. The mounting device as claimed in claim 11, wherein said first portion of said means for attaching said mounting device to said fence is at least one finger formed on said end section, and said at least one finger is attached at one end to said intermediate section and has an opposite end which is a free end, said second portion of said means for attaching said mounting device to said fence is at least one finger which is attached at one end to said intermediate section and has an opposite end which is a free end.

17. The mounting device as claimed in claim 16, wherein said first and second portions form an open ended gap.

18. The mounting device as claimed in claim 16, wherein said means in said intermediate section for attaching an item to said mounting device is a slot.

19. The mounting device as claimed in claim 16, wherein said means in said intermediate section for attaching an item to said mounting device is a plurality of apertures.

* * * * *